United States Patent [19]

Nelson

[11] 4,038,517

[45] July 26, 1977

[54] ENVIRONMENTALLY AND WEAR PROTECTED GLASS SUBSTRATE THIN FILM THERMAL PRINTHEADS

[75] Inventor: Laurence G. Nelson, Villa Park, Calif.

[73] Assignee: Rockwell International Corporation, El Segundo, Calif.

[21] Appl. No.: 673,249

[22] Filed: Apr. 2, 1976

[51] Int. Cl.[2] ..... H05B 1/00

[52] U.S. Cl. ..... 219/216; 219/543; 338/308; 338/309; 338/314; 427/103

[58] Field of Search ..... 219/216, 543; 346/76; 338/307–309, 314; 427/103; 428/446, 539

[56] References Cited

U.S. PATENT DOCUMENTS

| | | | |
|---|---|---|---|
| 3,496,333 | 2/1970 | Alexander et al. | 219/216 |
| 3,515,850 | 6/1970 | Cady | 219/216 |
| 3,931,492 | 1/1976 | Takano et al. | 219/543 X |

*Primary Examiner*—C. L. Albritton

*Attorney, Agent, or Firm*—H. Fredrick Hamann; G. Donald Weber, Jr; Robert Ochis

[57] ABSTRACT

Glass-substrate thin film thermal printheads are protected from both chemical contamination and the mechanical wear by a coating comprising aluminum oxide ($Al_2O_3$) over silicon monoxide (SiO) disposed on the printhead.

5 Claims, 1 Drawing Figure

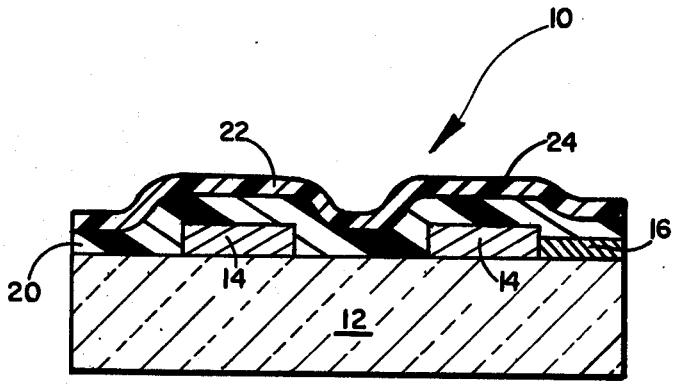
10
22
24
16
20
14
14
12

ENVIRONMENTALLY AND WEAR PROTECTED GLASS SUBSTRATE THIN FILM THERMAL PRINTHEADS

BACKGROUND OF THE INVENTION

1. Field of the Invention

The invention relates to the field of thin film, resistive thermal printheads.

2. Description of Prior Art

Resistive thin film thermal printheads are known in the art. Such printheads having the thin film thermal printing elements disposed on and supported by glass substrates have been produced with a protective coating of silicon monoxide (SiO) over the substrate and the printing element. The silicon monoxide flim is chemically stable in the presence of thermal printing paper and other environmental conditions normally encountered by thermal printheads. However, the silicon monoxide has insufficient abrasion resistance to provide acceptable thermal printhead life.

Other prior art thermal printheads have variously been provided with protective coatings of alumina ($Al_2O_3$), beryllia (BeO), silicon dioxide ($SiO_2$) and borosilicate glasses. However, for various reasons, these prior art protective coatings have been found to be inappropriate for use with the thin film printheads having CrSiO resistive elements disposed on borosilicate or soda-lime glass substrates. Consequently, thermal printheads of this type require improved environmental and wear protection.

SUMMARY OF THE INVENTION

The lifetime of thin film chromium silicon monoxide printing elements on glass substrate thermal printheads has been substantially increased via utilization of a two layer protective overcoat. In accordance with the invention, the two layer protective overcoat comprises a first layer of silicon monoxide and a second layer of aluminum oxide which is wear resistant, chemically shielding, thermally conductive and compatible with the chromium silicon monoxide thermal printing elements and glass substrate.

BRIEF DESCRIPTION OF THE DRAWING

The drawing FIGURE illustrates a cross-section through a thermal printhead illustrating the protective overcoat.

DETAILED DESCRIPTION OF THE PREFERRED EMBODIMENT

In order to protect the resistive printing elements and the associated thin film conductors of a thermal printhead from the chemicals contained in thermal printing paper and mechanical wear caused by paper movement, it is desirable to provide an overcoat on the thermal printhead. Such an overcoat must have sufficient thermal conductivity that the thermal energy generated by the printing elements is rapidly transmitted through the overcoat to the printing paper to effect a rapid, sharp printing of the desired characters. The overcoat must cool quickly to eliminate any smearing of the next succeeding image due to heat retention in the overcoat. The protective overcoat must also exhibit a temperature expansion coefficient in thin film layers which is compatible with that of the substrate materials. To be effective, the protective overcoat must (1) have a high thermal conductivity, (2) have a compatible coefficient of thermal expansion, (3) exhibit resistance to mechanical abrasion, (4) provide a shield which prevents chemical intrusion through the protective film to the resistive printing elements and (5) adhere to (a) the borosilicate or soda-lime glass which is utilized as the printhead substrate, (b) the conducting thin flim leads and (c) the thermal printing elements.

In a thermal printhead having a borosilicate or soda-lime glass substrate and chromium silicon monoxide (CrSiO) thermal printing elements, it has been found that silicon monoxide (SiO) provides adequate chemical shielding but insufficient wear resistance to serve as a satisfactory protective overcoat.

Silicon dioxide ($SiO_2$) protective coatings have been found to be excessively reactive with chemicals present in the environment to which thermal printheads are normally exposed. The silicon dioxide is believed to react with chemicals present in the thermal printing papers. Consequently, silicon dioxide is not a satisfactory protective layer. Aluminum oxide ($Al_2O_3$) has been found to be an inadequate protective overcoat because of a large mismatch between the coefficient of thermal expansion of the aluminum oxide and the substrate, printing element combination. This mismatch results in the aluminum oxide spalling or chipping off the substrate, conductors and printing elements, thereby exposing the printing elements, conductors and substrate to chemical attack and abrasion. Beryllia (BeO) is considered an undesirable protective coating because of its toxicity and consequent danger to both production personnel and to the user in the event of wear during use which produces beryllia dust, since inhaled beryllia dust attacks lung tissue.

Borosilicate glass has been found to yield an insufficient useful life because borosilicate glass is chemically reactive in the thermal printing environment and offers insufficient mechanical wear resistance when utilized in layers which are thin enough to have a sufficient thermal conductivity to provide acceptable printing.

In accordance with the preferred embodiment of the invention, it has been found that the problems of prior art protective overcoats can be avoided in glass-substrate thin-film thermal printheads through use of a two layer, chemically inert, protective overcoat comprising a fist layer of silicon monoxide and a second layer of aluminum oxide. Silicon monoxide is chemically inert in the thermal printing environment, provides good molecular adhesion to the glass substrate, the thin film printing elements and the thin film conductors and has a linear coefficient of thermal expansion which minimizes the problem of spalling of a protective coating. Aluminum oxide provides further chemical shielding and excellent abrasion resistance and has good molecular adhesion to the silicon monoxide layer. Thus, the two layer protective overcoat provides a degree of chemical protection and wear resistance which is not provided by either layer alone.

A thermal printhead which has been protected in accordance with the invention is illustrated generally at 10 in the figure. The thermal printhead 10 comprises a borosilicate or soda-lime glass substrate 12 upon which resistive printing elements 14 and copper conductors 16 have been deposited. The printing elements 14 are preferably chromium silicon monoxide (CrSiO). The overcoat layer of silicon monoxide 20 is deposited on the printhead 10 because of its good adhesion to the glass of substrate 12, the resistive elements 14 and the conductors 16. An aluminum oxide layer 22 is deposited on the silicon monoxide layer 20 because of its good adhesion to the silicon monoxide. The upper surface 24 of the layer 22 comprises the printing paper contacting surface of the printhead 10.

In accordance with the invention, the silicon monoxide layer is deposited by evaporation in a vacuum. For deposition, a vacuum of $10^{-5}$ torr. is preferred in order to prevent contamination of the film. The thermal printhead substrates are preferably heated to the temperature range of 350°–450° C to encourage good adhesion of the silicon monoxide film to the substrate. The silicon monoxide may preferably be filament evaporated at between 1000° C and 1100° C. During deposition, the substrates are rotated with respect to the silicon monoxide source in order to promote complete coverage of the steps at the edge of the resistive film and to prevent the formation of voids. The films are preferably deposited to a thickness of 3000–10,000 A in order to obtain a layer which is structurally sound, adherent and thermally conductive. Subsequently, the second layer is deposited. The second deposition is preferaby performed without breaking the vacuum in the vacuum chamber in order to prevent contamination of the silicon monoxide film prior to the deposition of the second layer. For the deposition of the second layer, the substrate temperature is preferably 350°–450° C and the substrates are rotated with respect to the source of aluminum oxide. The aluminum oxide is preferably deposited by electron beam evaporation of pressed aluminum oxide pellets in a vacuum of $10^{-5}$ to $10^{-4}$ torr. The aluminum oxide is preferably deposited to a film thickness of 3000–10,000 A.

It has been found that thermal printheads protected in accordance with the invention exhibit lifetimes which are substantially longer than those which are protected by the prior art process. In particular, life cycle tests have established that the thermal printheads, in accordance with the invention, have a lifetime which is at least twenty times that of the prior art printhead protected by silicon monoxide alone.

Although aluminum oxide is preferred as the second overcoat, other materials may be utilized. Among the other materials which may be utilized are zirconium oxide and chromium oxide. Similarly, other deposition techniques than those specified may be utilized. The overcoat may also be utilized with printheads formed of other materials so long as the above-discussed compatibility criterion are met.

What is claimed is:

1. A thermal printhead comprising:

a glass substrate;

thin film thermal printing elements disposed on said substrate;

thin film conductors disposed on said substrate and electrically connected to said printing elements; and a protective overcoat consisting of a first layer of silicon monoxide disposed on said substrate, said printing elements and said conductors, and a second layer of a material selected from the group consisting of aluminum oxide, zirconium oxide, and chromium oxide.

2. The thermal printhead recited in claim 1 wherein the glass of said substrate is selected from the group consisting of borosilicate and soda-lime glass.

3. The thermal printhead recited in claim 1 wherein said printing elements are chromium silicon monoxide.

4. The thermal printhead recited in claim 1 wherein:

the glass of said substrate is selected from the group consisting of borosilicate and soda-lime glass;

said printing elements are chromium silicon monoxide; and said second layer is aluminum oxide.

5. The thermal printhead recited in claim 4 wherein said conductors are copper.

* * * * *